US010045625B2

(12) United States Patent
Johnson

(10) Patent No.: US 10,045,625 B2
(45) Date of Patent: Aug. 14, 2018

(54) RECLINER FOOTREST EXTENSION SYSTEM AND METHOD

(71) Applicant: Charles Johnson, Omak, WA (US)

(72) Inventor: Charles Johnson, Omak, WA (US)

( * ) Notice: Subject to any disclaimer, the term of this patent is extended or adjusted under 35 U.S.C. 154(b) by 44 days.

(21) Appl. No.: 15/365,930

(22) Filed: Nov. 30, 2016

(65) Prior Publication Data

US 2017/0150820 A1 Jun. 1, 2017

Related U.S. Application Data

(60) Provisional application No. 62/260,683, filed on Nov. 30, 2015.

(51) Int. Cl.

| | |
|---|---|
| ***A47C 7/50*** | (2006.01) |
| ***A47C 20/00*** | (2006.01) |
| ***A47C 1/034*** | (2006.01) |
| ***A47C 7/54*** | (2006.01) |

(52) U.S. Cl.

CPC ..... *A47C 7/506* (2013.01); *A47C 1/034* (2013.01); *A47C 7/546* (2013.01)

(58) Field of Classification Search

CPC .. A47C 7/506; A47C 7/50; A47C 7/62; A47C 7/52; A47C 1/034

USPC ..... 297/423.35, 423.25, 423.26, 423.29, 297/423.3, 423.31, 423.4, 423.19, 68–70

See application file for complete search history.

(56) References Cited

U.S. PATENT DOCUMENTS

| | | | | | |
|---|---|---|---|---|---|
| 576,490 | A | * | 2/1897 | Wells | B60N 2/2352 297/314 |
| 2,278,078 | A | * | 3/1942 | Kahn | A47D 1/008 297/423.32 |
| 2,683,482 | A | * | 7/1954 | Puls | A47D 3/005 108/27 |
| 3,215,469 | A | * | 11/1965 | Wamsley | A47C 1/035 108/135 |
| 3,494,660 | A | * | 2/1970 | Caldemeyer | A47C 1/034 297/68 |
| 3,869,169 | A | | 3/1975 | Johnson et al. | |
| 3,904,240 | A | | 9/1975 | Rogers, Jr. et al. | |
| 4,336,965 | A | | 6/1982 | Lipp | |
| 4,506,925 | A | | 3/1985 | Crum | |
| 4,660,883 | A | | 4/1987 | Kowalski | |
| 4,669,778 | A | | 6/1987 | Rogers, Jr. et al. | |
| 4,715,654 | A | | 12/1987 | Laskowitz | |
| 5,228,745 | A | * | 7/1993 | Hazel | B60N 2/286 297/219.12 |
| 5,419,611 | A | | 5/1995 | Cook | |
| 5,507,562 | A | | 4/1996 | Wieland | |
| 5,890,766 | A | * | 4/1999 | Tsai | A47C 7/506 297/423.28 |

(Continued)

*Primary Examiner* — Mark R Wendell

(74) *Attorney, Agent, or Firm* — Integrity Patent Group, PLC; Edwin Wold

(57) ABSTRACT

A recliner footrest extension system includes a base-member, and an extension-member. The base-member includes a top-panel, a bottom-panel, and a side-panel in one embodiment. The top-panel, the bottom-panel, and the side-panel are structured and arranged to affix to a recliner footrest by sliding upon the recliner footrest and held upon the footrest by friction. The extension-member is affixed to the base-member by a hinge, with the extension member arranged to support at least one foot of a user when the recliner footrest extension system is in an extended condition.

17 Claims, 5 Drawing Sheets

(56) References Cited

U.S. PATENT DOCUMENTS

| | | | | |
|---|---|---|---|---|
| 6,264,278 | B1 * | 7/2001 | Weimer | B60N 2/28 297/256.11 |
| 7,121,627 | B2 | 11/2006 | Gaikwad et al. | |
| 7,273,257 | B2 | 9/2007 | De Vroe | |
| 8,602,499 | B2 | 12/2013 | Driessen et al. | |
| 8,752,890 | B2 | 6/2014 | Murphy et al. | |
| 2004/0094668 | A1 * | 5/2004 | Jarosz | B60N 3/063 244/118.5 |
| 2009/0102257 | A1 * | 4/2009 | Collias | B60N 2/2806 297/256.16 |
| 2009/0199339 | A1 * | 8/2009 | Barr | A61G 13/02 5/602 |
| 2011/0240797 | A1 | 10/2011 | Behe | |
| 2014/0210251 | A1 | 7/2014 | Griggs, Jr. | |
| 2015/0274053 | A1 * | 10/2015 | Carlioz | B60N 3/063 297/423.26 |
| 2015/0374565 | A1 * | 12/2015 | Patel | A61G 5/1075 297/362.12 |

* cited by examiner

RECLINER FOOTREST EXTENSION SYSTEM AND METHOD

CROSS-REFERENCE TO RELATED APPLICATION

The present application is related to and claims priority to U.S. Provisional Patent Application No. 62/260,683 filed Nov. 30, 2015, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of leg and foot supports and more specifically relates to recliner footrest extensions.

2. Description of Related Art

Reclining chairs and sofas are common in today's modern home furnishings. The reclining mechanisms of this type of furniture are generally operable by a push-button or lever to allow the user to extend a footrest and recline the back support. Most recliners can be retracted by either using the lever or by the user pressing back on the footrest. Recliners are most often designed and manufactured for an average-sized user.

Problems exist when the user is taller than the average person because the footrest may support the legs of a tall user in a location that is far from the feet causing discomfort, leg circulation problems, and difficulty extending and retracting the leg support.

Various attempts have been made to solve problems found in the leg supports art. Among these are found in: U.S. Patent and Publication Nos. U.S. Pat. No. 8,602,499 to Driessen et al., 2011/0240797 to Behe, U.S. Pat. No. 7,121,627 to Gaikwad et al., U.S. Pat. No. 5,507,562 to Wieland, U.S. Pat. No. 4,336,965 to Lipp, 2014/0210251 to Griggs, Jr., U.S. Pat. No. 3,869,169 to Johnson et al., U.S. Pat. Nos. 3,904,240, 4,570,966, and 4,669,778 to Rogers, Jr. et al., U.S. Pat. No. 4,506,925 to Crum, U.S. Pat. No. 4,660,883 to Kowalski, U.S. Pat. No. 4,715,654 to Laskowitz, U.S. Pat. No. 5,419,611 to Cook, U.S. Pat. No. 7,273,257 to De Vroe, and U.S. Pat. No. 8,752,890 to Murphy, et al. This prior art is representative of leg supports.

BRIEF SUMMARY OF THE INVENTION

The present invention advantageously fills the aforementioned deficiencies by providing a recliner footrest extension system that is able to be quickly and easily operated by the user while not interfering with the normal operations of the recliner. The present invention is superior to other systems in that it effectively attaches to the standard footrest of the recliner and allows the feet and legs of a tall user to be supported in a more comfortable position.

The present invention relates to a recliner footrest extension system that slips onto the footrest of a normal recliner and extends to an 'in-use' condition to support the feet and lower legs of a user by folding outward to provide a support point which is lower than would be available without the user of the recliner footrest extension system. The recliner footrest extension system may comprise a base which attaches to the footrest of the recliner by friction and a leg support member attached to the base component by one or more hinges. In a preferred embodiment, the base of the recliner footrest extension may include a base-member and an extension-member A recliner footrest extension system is disclosed herein in various embodiments. The recliner footrest extension system includes a base-member, and an extension-member. The base-member includes a top-panel, a bottom-panel, and a side-panel in one embodiment. The top-panel, the bottom-panel, and the side-panel are structured and arranged to affix to a recliner footrest by sliding upon the recliner footrest and held upon the footrest by friction.

The extension-member is affixed to the base-member by a hinge, with the extension member arranged to support at least one foot of a user when the recliner footrest extension system is in an extended condition. In an embodiment, the extension-member includes a padded-member, the padded-member useful for providing additional comfort to the feet/foot of the user. Also, the top-panel and bottom-panel each preferably include a rubberized surface to provide additional friction between the recliner footrest extension system and the footrest of the recliner. The extension-member may be removable from the base-member and replaceable in an embodiment In an embodiment, the recliner footrest extension system is constructed from a plastic material to be lightweight and durable, where the plastic material is opaque to be less noticeable to the user. Also, the recliner footrest extension system is preferably constructed from an anti-fungal material for improved sanitation, and the footrest extension system, when in a closed position, is substantially flat as to not interfere with the extension or retraction of the recliner footrest, in a preferred embodiment.

According this embodiment, a method of using a recliner footrest extension system is also disclosed herein. The method of using a recliner footrest extension system includes step one, providing a recliner footrest extension system and a recliner; step two, affixing the recliner footrest extension system to the footrest of the recliner, with the recliner being in a reclined position; step three, extending the recliner footrest extension system from a closed position to an extended position; step four, placing at least one foot of the user upon the recliner footrest extension and the recliner footrest; step five, removing the at least one foot of the user from the recliner footrest extension system and the recliner; step six, retracting the recliner footrest extension system into the closed position from the extended position; and step seven, removing the recliner footrest extension system from the recliner.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a recliner footrest extension system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to leg and foot supports and more particularly to a recliner footrest extension system as used to improve the comfort of a recliner for individuals who may be tall by placing support beneath the legs and/or feet of the individual.

Generally speaking, the recliner footrest extension system slips onto the footrest of a recliner (e.g., recliner chair, reclining couch, etc.) and extends outward to support the feet and lower legs of a user by folding outward. A recliner footrest extension system provides a support point which is lower and more comfortable for a tall user than would be available without the user of the recliner footrest extension. A recliner footrest extension may include a base which attaches to the footrest of the recliner by friction and a leg support member that is attached to the base component by a hinge or hinges. Recliner footrest extension systems may fold flat when not in use as to not interfere with the normal operations of a recliner.

Figure 1:
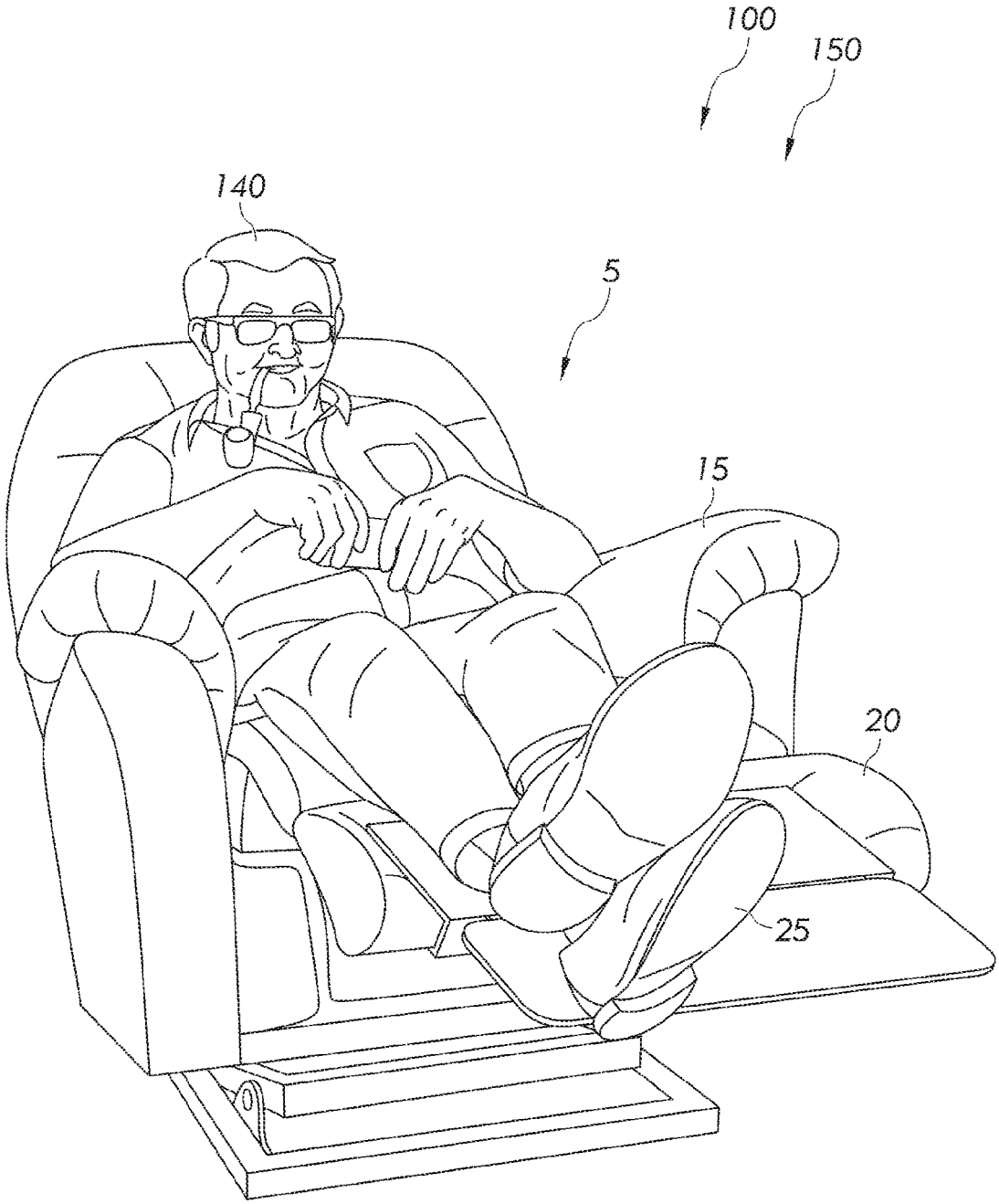
FIG. 1 is a perspective view of a recliner footrest extension system during an 'in-use' condition, according to an embodiment of the disclosure.
Figure 2:
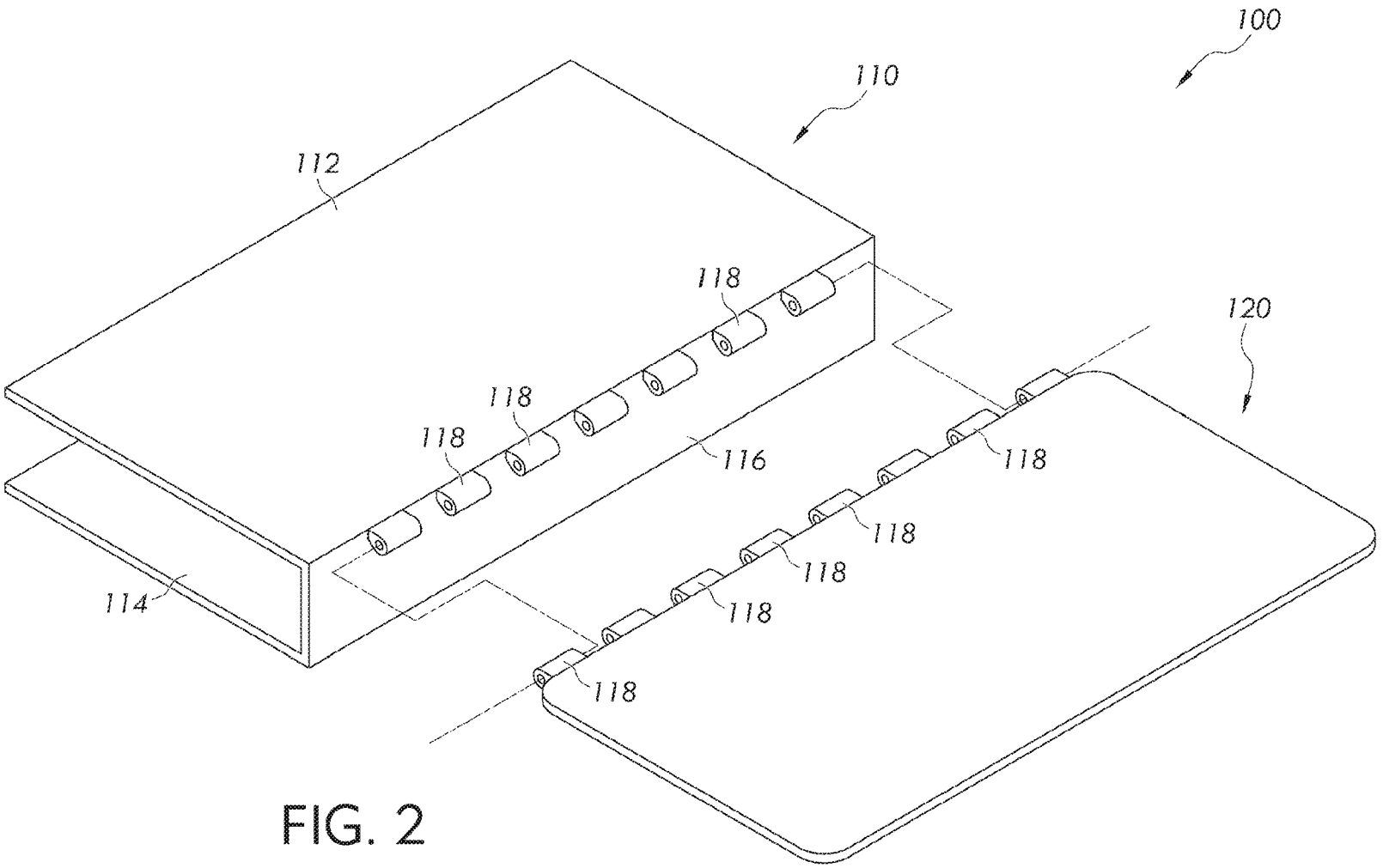
FIG. 2 is an exploded perspective view of the recliner footrest extension system of FIG. 1, according to an embodiment of the present disclosure.
Figure 3A:
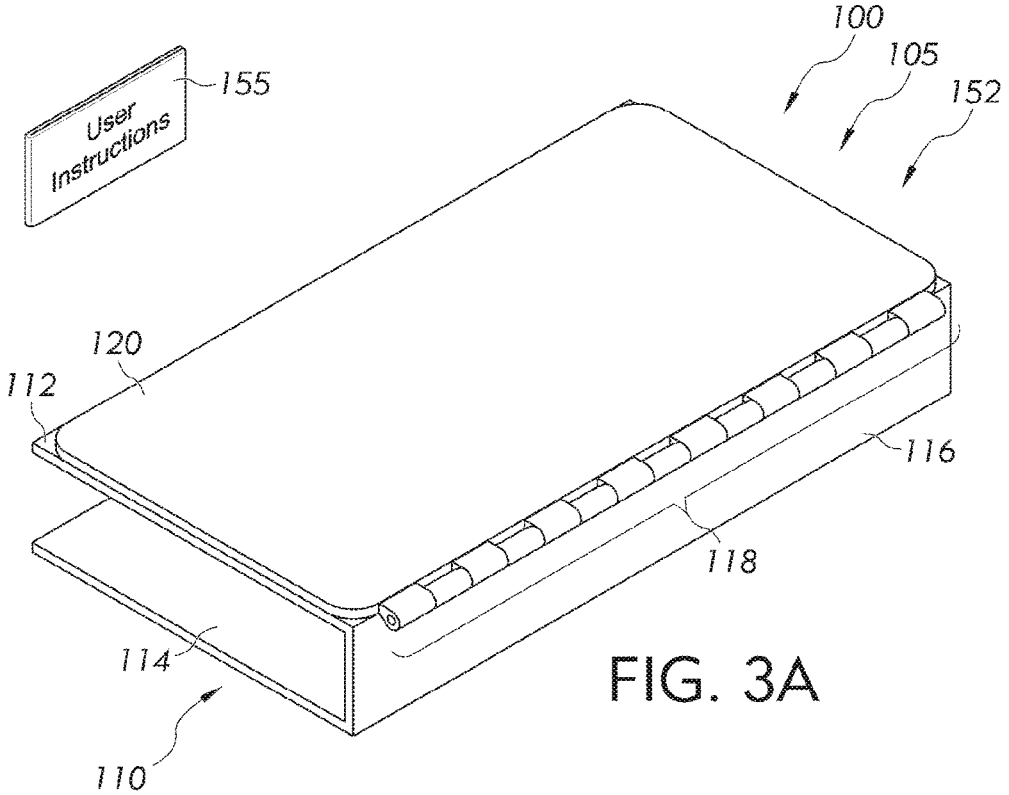
FIG. 3A is a perspective view of the recliner footrest extension system of FIG. 1, in a closed position, according to an embodiment of the present disclosure.
Figure 3B:
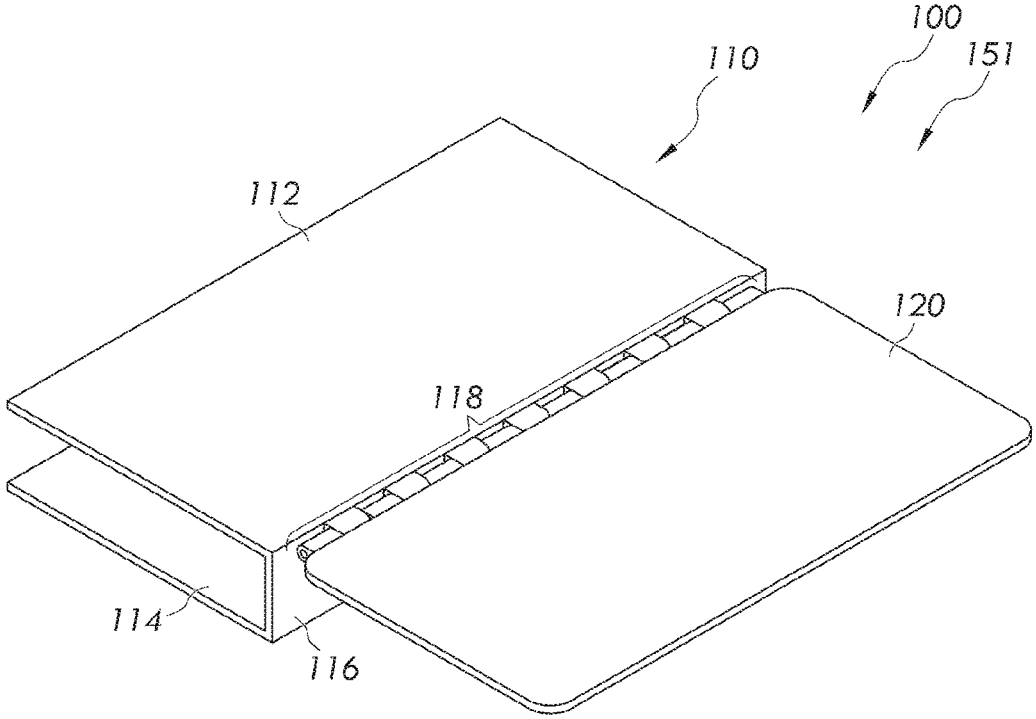
FIG. 3B is a perspective view of the recliner footrest extension system of FIG. 1, in an extended position, according to an embodiment of the present disclosure.
Figure 4:
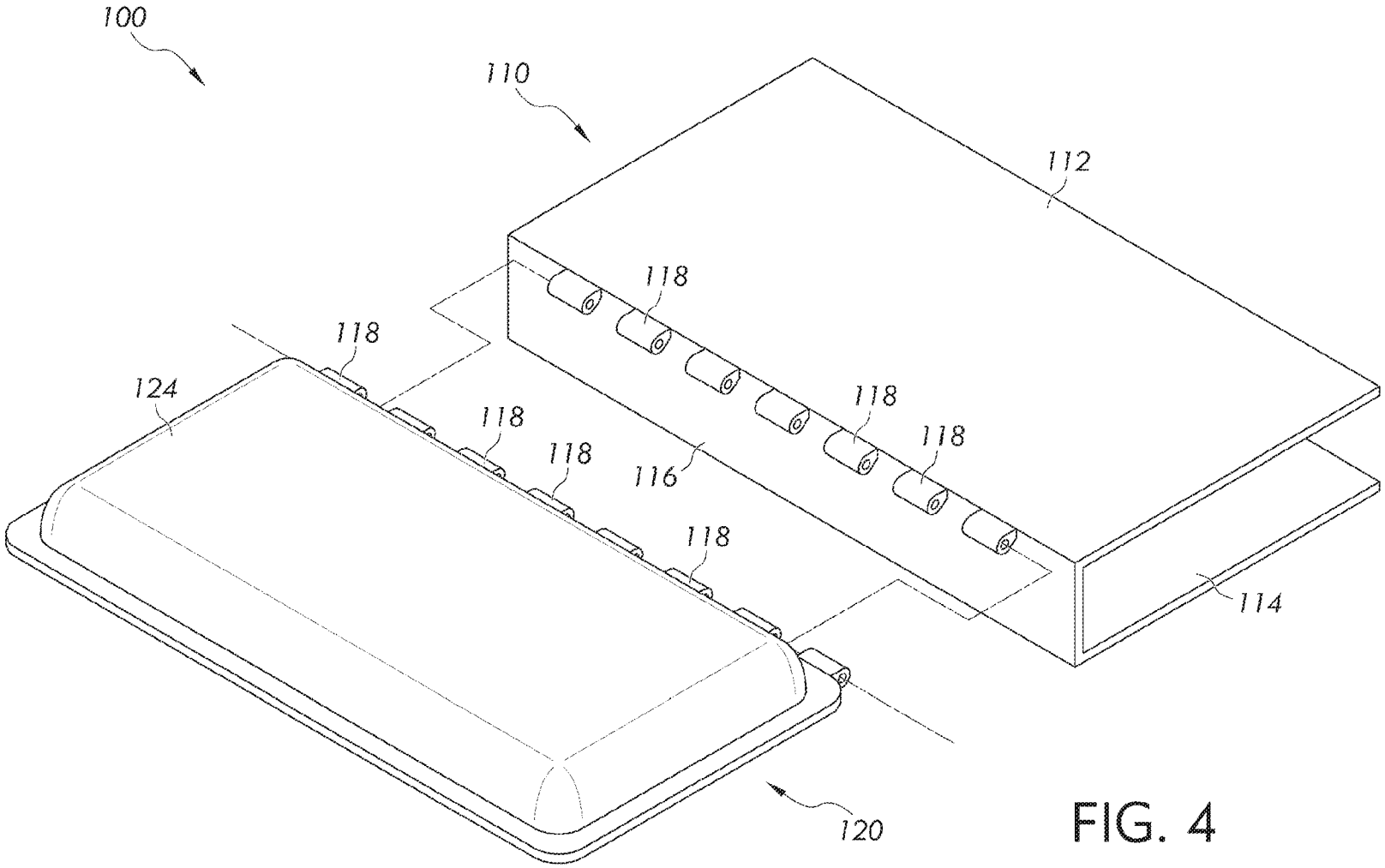
FIG. 4 is an exploded perspective view of the recliner footrest extension system of FIG. 1, including a padded-member, according to an embodiment of the present disclosure.

Referring now more specifically to the drawings by numerals of reference, there is shown in FIGS. 1-4, various views of recliner footrest extension system 100. FIG. 1 shows recliner footrest extension system 100 during an 'in-use' condition 150, according to an embodiment of the present disclosure. Here, recliner footrest extension system 100 may be beneficial for use by a user 140 to providing support to legs and/or feet 25 of user 140 when user 140 is sitting in recliner 15. Such support is especially useful for tall individuals or individuals that have long legs such that a traditional recliner footrest 20 would not be effectively comfortable.

As illustrated, the recliner footrest extension system 100 may include base-member 110 and extension-member 120. Base-member 110 may include top-panel 112, bottom-panel 114, and side-panel 116, with top-panel 112, bottom-panel 114, and side-panel 116 arranged to slideably affix to recliner footrest 20. Extension-member 120 may be removable from base-member 110 and replaceable.

Extension-member 120 may be hingedly coupled to base-member 110 (by hinge 118), with extension-member 120 arranged to support at least one foot 25 of user 140 in extended condition 151. Extension-member 120 may further include padded-member 124, useful for providing additional comfort to at least one foot 25 of user 140.

Top-panel 112 may further include a rubberized surface to provide additional friction between recliner footrest extension system 100 and recliner footrest 20. Similarly, bottom-panel 114 may further include a rubberized surface to provide additional friction between recliner footrest extensions system 100 and recliner footrest 20.

Recliner footrest extension system 100 may be constructed from a plastic material to be lightweight and durable. The plastic material may be clear to be less noticeable to user 140 (and others), in some embodiments. In other embodiments, the plastic material may be constructed from a predetermined color to match a color of recliner 15 to be less noticeable. Further, the plastic material may include a predetermined pattern to provide improved aesthetics to recliner footrest extension system 100, or plastic material may include a logo to provide enthusiasm for an entity related to the logo. Other materials may be used.

Plastic material may be opaque to be less noticeable to user 140 and recliner footrest extension system 100 may be constructed from a ferrous-metallic material for strength and durability. Recliner footrest extension system 100 may be constructed from an anti-fungal material for improved sanitation. Recliner footrest extension system 100, when in closed position 152, may be substantially flat as to not interfere with the extension or the retraction of recliner footrest 20.

According to one embodiment, the recliner footrest extension system 100 may be arranged as a kit 105. In particular, the recliner footrest extension system 100 may further include a set of instructions 155. The instructions 155 may detail functional relationships in relation to the structure of the recliner footrest extension system 100 (such that the recliner footrest extension system 100 can be used, maintained, or the like, in a preferred manner).

Figure 5:
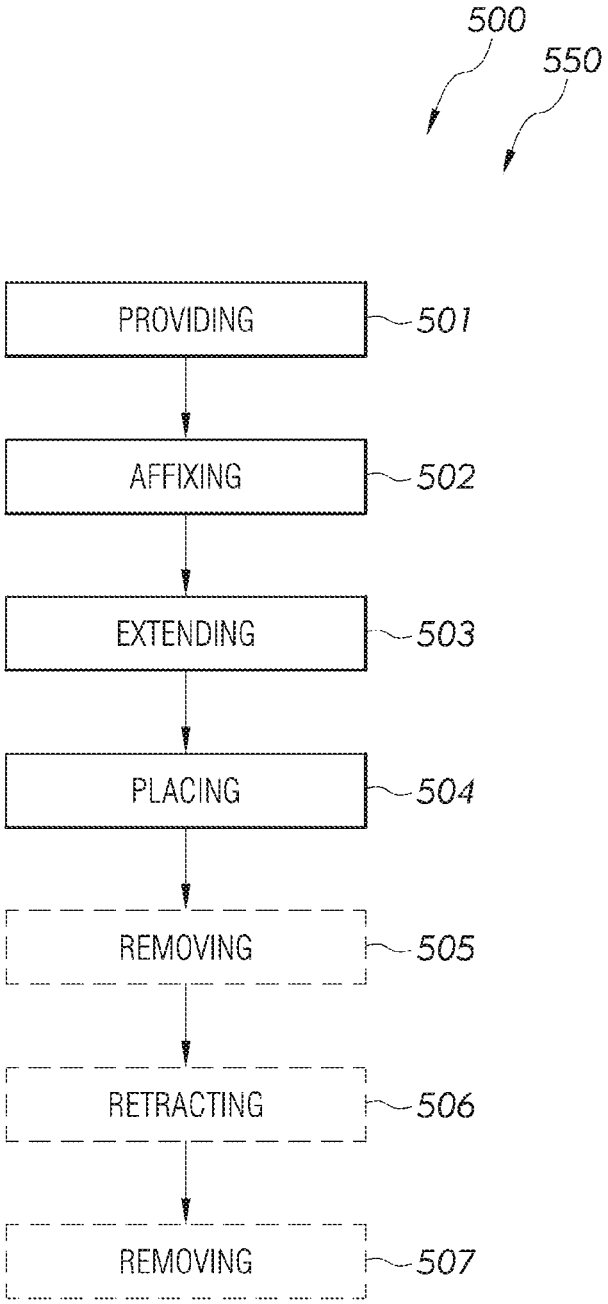
FIG. 5 is a flow diagram illustrating a method of using the recliner footrest extension system, according to an embodiment of the present disclosure.

FIG. 5 is a flow diagram illustrating a method for using recliner footrest extension system 100, according to an embodiment of the present disclosure. In particular, the method 500 may include one or more components or features of the recliner footrest extension 100 as described above. As illustrated, the method 500 may include the steps of: step one 501, providing recliner footrest extension system 100 and recliner 15; step two 502, affixing recliner footrest extension system 100 to recliner footrest 20, with recliner 15 being in a reclined position 5; step three 503, extending recliner footrest extension system 100 from a closed position 152 to an extended condition 151; step four 504 placing at least one foot 25 of user 140 upon recliner footrest extension system 100 and recliner footrest 20; step five 505 removing at least one foot 25 of user 140 from recliner footrest extension system 100 and recliner 15; step six 506, retracting recliner footrest extension system into closed position 152 from extended condition 151; and step seven 507, removing recliner footrest extension system 100 from recliner 15.

It should be noted that step five 505, step six 506, and step seven 507 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference.

The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for using a recliner footrest extension system 100 (e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A recliner footrest extension system, the system comprising: a base-member including a top-panel, a bottom-panel, and a side-panel, with said top-panel, said bottom-panel, and said side-panel arranged to slideably friction-affix to a recliner footrest; an extension-member hingedly coupled to said base-member, with said extension member arranged to support at least one foot of a user in an extended condition; and a padded-member; wherein said extension-member is structured and arranged with said base-member and the recliner footrest to establish the user support point which is lower, relative to an upper surface of the recliner footrest, than any recliner-footrest-user-support point available to the user when not using said recliner footrest extension system; wherein said padded-member is structured and arranged with said extension-member for providing additional comfort for said at least one foot of the user; wherein said top-panel further includes a first rubberized surface to provide additional friction between said recliner footrest extension system and said recliner footrest; and wherein said bottom-panel further includes a second rubberized surface to provide additional friction between said recliner footrest extension system and said recliner footrest.

2. The recliner footrest extension system of claim 1, wherein said extension-member is removable from said base-member and replaceable.

3. The recliner footrest extension system of claim 1, wherein said recliner footrest extension system is constructed from a plastic material to be lightweight and durable.

4. The recliner footrest extension system of claim 1, wherein said recliner footrest extension system is constructed from a ferrous-metallic material for strength and durability.

5. The recliner footrest extension system of claim 1, wherein said recliner footrest extension system is constructed from a non-ferrous-metallic material to be lightweight, durable, and flexible.

6. The recliner footrest extension system of claim 3, wherein said plastic material is clear to be less noticeable to said user.

7. The recliner footrest extension system of claim 3, wherein said plastic material is opaque to be less noticeable to said user.

8. The recliner footrest extension system of claim 3, wherein said plastic material is a predetermined color to match a color of said recliner.

9. The recliner footrest extension system of claim 3, wherein said plastic material is a predetermined color to compliment a color of said recliner.

10. The recliner footrest extension system of claim 3, wherein said plastic material includes a predetermined pattern to provide improved aesthetics to said recliner footrest extension system.

11. The recliner footrest extension system of claim 3, wherein said plastic material includes a logo to provide enthusiasm for an entity associated with said logo.

12. The recliner footrest extension system of claim 1, wherein said recliner footrest extension system is constructed from an anti-fungal material for improved sanitation.

13. The recliner footrest extension system of claim 1, wherein said recliner footrest extension system, when in a closed position, is substantially flat as to not interfere with an extension and/or retraction of said recliner footrest.

14. A recliner footrest extension system, said recliner footrest extension system comprising:

a base-member including a top-panel, a bottom-panel, and aft side-panel, with said top-panel, said bottom-panel, and said side-panel arranged to slideably friction-affix to a recliner footrest;

an extension-member hingedly coupled to said base-member, with said extension member arranged to support at least one foot of a user in an extended condition; and a padded-member;

wherein said extension-member is structured and arranged with said base-member and the recliner footrest to establish the user support point which is lower, relative to an upper surface of the recliner footrest, than any recliner-footrest-user-support point available to the user when not using said recliner footrest extension system;

wherein said padded-member is structured and arranged with said extension-member for providing additional comfort said at least one foot of the user;

wherein said top-panel includes a first rubberized surface to provide additional friction between said recliner footrest extension system and said footrest of said recliner;

wherein said bottom-panel includes a second rubberized surface to provide additional friction between said recliner footrest extension system and said footrest of said recliner;

wherein said extension-member is removable from said base-member and replaceable;

wherein said recliner footrest extension system is constructed from a plastic material to be lightweight and durable;

wherein said plastic material is opaque to be less noticeable to said user;

wherein said recliner footrest extension system is constructed from an anti-fungal material for improved sanitation; and wherein said recliner footrest extension system, when in a closed position, is substantially flat as to not interfere with an extension or retraction of said recliner footrest.

15. The recliner footrest extension system of claim 14, further comprising set of instructions; and wherein said recliner footrest extension system is arranged as a kit.

16. A method of using the recliner footrest extension system of claim 14, the method comprising the steps of: providing the recliner footrest extension system of claim 14 and a recliner; affixing said recliner footrest extension system to a recliner footrest of said recliner, with said recliner being in a reclined position; extending said recliner footrest extension system from a closed position to an extended condition; and placing at least one foot of a user upon said recliner footrest extension and said recliner footrest.

17. The method of claim 16, further comprising the steps of:

removing said at least one foot of said user from said recliner footrest extension system and said recliner;

retracting said recliner footrest extension system into said closed position from said extended condition; and removing said recliner footrest extension system from said recliner.

* * * * *